US007011021B2

(12) United States Patent
Dzierzynski et al.

(10) Patent No.: US 7,011,021 B2
(45) Date of Patent: Mar. 14, 2006

(54) PRINTING BLANKET SLEEVE WITH REPLACEABLE PRINTING SURFACE

(75) Inventors: Edward P. Dzierzynski, Ashville, NC (US); Michael E. McLean, Waynesville, NC (US); Melvin D. Pinkston, Hendersonville, NC (US); Philip K. Loyer, Waynesville, NC (US); Dennis R. Wolters, Dayton, OH (US)

(73) Assignee: Day International, Inc., Dayton, OH (US)

( * ) Notice: Subject to any disclaimer, the term of this patent is extended or adjusted under 35 U.S.C. 154(b) by 489 days.

(21) Appl. No.: 09/950,184

(22) Filed: Sep. 10, 2001

(65) Prior Publication Data

US 2003/0047097 A1 Mar. 13, 2003

(51) Int. Cl.
*B41N 10/04* (2006.01)

(52) U.S. Cl. ..... 101/217; 101/376; 101/401.1

(58) Field of Classification Search ..... 101/217, 101/375, 376, 401.1; 29/895.23; 492/4, 492/18, 49, 56; 428/909; B41N 10/04
See application file for complete search history.

(56) References Cited

U.S. PATENT DOCUMENTS 2,054,620 A * 9/1936 Freedlander ..... 101/217
3,035,331 A 5/1962 Wieman
3,978,254 A 8/1976 Hoexter et al.
3,982,312 A * 9/1976 Finzer ..... 492/56
4,119,032 A 10/1978 Hollis
4,144,813 A 3/1979 Julian
4,378,622 A 4/1983 Pinkston et al.
4,537,129 A 8/1985 Heinemann et al.
4,812,219 A 3/1989 Sattrup et al.
4,949,445 A 8/1990 Van Der Meulen et al.
5,168,808 A 12/1992 Prem
5,289,769 A 3/1994 Lewis
5,351,615 A 10/1994 Kobler et al.
RE34,970 E 6/1995 Tittgemeyer
5,440,981 A 8/1995 Vrotacoe et al.
5,507,226 A 4/1996 Burke et al.
5,507,228 A 4/1996 Schulz
5,535,674 A 7/1996 Vrotacoe et al.
5,544,584 A 8/1996 Thompson et al.
5,553,541 A 9/1996 Vrotacoe et al.
5,654,100 A 8/1997 Kobler et al.
5,706,731 A * 1/1998 Francille et al. ..... 101/375
5,740,738 A 4/1998 Niemiro (Continued)

FOREIGN PATENT DOCUMENTS

GB 2 051 681 A 1/1981

(Continued)

*Primary Examiner*—Leslie J. Evanisko
(74) *Attorney, Agent, or Firm*—Dinsmore & Shohl LLP

(57) ABSTRACT

A printing blanket sleeve is provided having two separable sections including a carcass sleeve and a face sleeve. The face sleeve is mounted over the carcass sleeve such that, when the printing blanket sleeve is installed on a blanket cylinder, the carcass sleeve and the face sleeve form an integral unit in use. The printing blanket sleeve is provided in separable sections so that the printing surface may be replaced in a manner wherein the carcass sleeve, including preferably at least some portion of the inner layers, can be reused with new printing surfaces. Further, the printing blanket sleeve is arranged such that the user of the printing blanket sleeve can change the printing surface of the printing blanket sleeve on-site so that there is no longer a need to discard the entire printing blanket sleeve, or alternatively send the printing blanket sleeve back to the manufacturer to be reconditioned.

36 Claims, 5 Drawing Sheets

U.S. PATENT DOCUMENTS 5,752,444 A * 5/1998 Lorig ..... 101/375
5,768,990 A 6/1998 Vrotacoe et al.
5,778,779 A 7/1998 Jones et al.
5,782,181 A * 7/1998 Rossini ..... 101/153
5,813,334 A 9/1998 Blanchard
5,813,336 A 9/1998 Guaraldi et al.
5,816,154 A 10/1998 Stuart
5,819,657 A * 10/1998 Rossini ..... 101/376
5,832,824 A 11/1998 Okubo et al.
5,983,799 A 11/1999 Lane, III et al.
6,038,975 A * 3/2000 Hoffmann et al. ..... 101/375
6,148,725 A 11/2000 Knauer et al.
6,276,271 B1 * 8/2001 Busshoff ..... 101/375
6,283,026 B1 * 9/2001 Tocheport et al. ..... 101/375
6,347,582 B1 2/2002 Jones
6,360,662 B1 3/2002 Busshoff
6,374,734 B1 * 4/2002 Gaffney et al. ..... 101/376
6,382,102 B1 * 5/2002 Herrmann et al. ..... 101/376
6,389,965 B1 * 5/2002 Vrotacoe et al. ..... 101/217
6,401,613 B1 * 6/2002 Gayle et al. ..... 101/375
2002/0002920 A1 * 1/2002 Dilling et al. ..... 101/368

FOREIGN PATENT DOCUMENTS

WO WO 97/29897 8/1997

* cited by examiner

PRINTING BLANKET SLEEVE WITH REPLACEABLE PRINTING SURFACE

BACKGROUND OF THE INVENTION

The present invention relates in general to a printing blanket sleeve and in particular to a seamless printing blanket sleeve having a replaceable printing surface.

A typical blanket cylinder on an offset printing press includes an axially extending groove, or lock up gutter with clamping segments. Printing blankets are provided in sheets that are wrapped around the blanket cylinder such that the opposite ends of the printing blanket are inserted and clamped in the groove. Because the loose ends of the blanket must be secured to the cylinder, the surface of the blanket when mounted will have a gap where the edges are drawn. As a consequence, print quality, speed of operation, and available print region dimensions are affected. Press downtime, including printing blanket change over time, can also be excessive.

These problems can be minimized where the printing blanket is provided as a gapless sleeve that is capable of mounting onto the blanket cylinder. Because the sleeve is essentially stretched while on the blanket cylinder however, the sleeve is exposed to considerable peripheral and circumferential forces. Additionally, while operating the press, the blanket sleeve is exposed to high revolution speeds and impact with other components of the press, including a plate cylinder with printing plates. As such, the printing blanket sleeve will eventually dynamically fatigue. Where the printing blanket sleeve has experienced sufficient dynamic fatigue, print quality will be affected, and the printing blanket sleeve must be replaced. However, it is usually either the printing surface, or the adhesive that holds the printing surface to the first internal layer, that will fail. The remaining layers are often functionally intact.

Currently, some fatigued printing blanket sleeves are discarded. This leads to considerable waste and cost as the materials used to construct the base layer and internal layers constitute a significant portion of the total materials cost for the sleeve production. Alternatively, the fatigued printing blanket sleeves are sent back to the manufacturer to be reconditioned or "recapped". While reconditioning allows for recycling of certain reusable portions of the fatigued printing blanket sleeve, the press operator must ship the entire printing blanket sleeve back to the manufacturer. The manufacturer must remove the worn portions of the printing blanket sleeve, and assemble a new printing surface and internal components to the printing blanket sleeve. This causes considerable cost to the manufacturer. Further, some sleeves returned to the manufacturer have damage to the nickel base from shipping or handling and cannot be reprocessed.

Therefore, there is a need for a gapless printing blanket that allows for a simple changeover of the printing surface of a fatigued printing blanket sleeve, where the changeover can be accomplished directly on the press, or on-site, near the press.

SUMMARY OF THE INVENTION

The present invention overcomes the disadvantages of previous printing sleeves by providing a renewable printing sleeve where the printing surface and optionally, one or more support layers, are removed from the printing sleeve and replaced.

According to one aspect of the present invention, a printing blanket sleeve includes two separable sections, including a carcass sleeve and a face sleeve. The carcass sleeve comprises a base sleeve, and preferably one or more internal layers including a compressible layer. The face sleeve comprises a first internal surface and a printing surface. The compressible layer may alternatively be included with the face sleeve between the first internal surface and the printing surface. The face sleeve is installed over the carcass sleeve to define a printing blanket sleeve. When the printing blanket sleeve is installed on a blanket cylinder of a printing press, the carcass sleeve and the face sleeve rotate as an integral unit. Should the printing surface excessively wear or fatigue, the face sleeve may be replaced. However, the carcass sleeve may be recycled for numerous lifetimes by installing a new face sleeve over the existing carcass sleeve.

Further, the printing blanket sleeve is arranged such that the user of a printing press can preferably replace the face sleeve on-site, and more preferably at or near the machinery, so that there is no longer a need to either discard the entire printing blanket sleeve, or alternatively to send the printing blanket sleeve back to the manufacturer to be recapped.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that mechanical changes may be made without departing from the spirit and scope of the present invention. Reference is made to the figures, which illustrate printing blanket sleeve construction according to the present invention. It will be appreciated that these are diagrammatic figures, and that the dimensions are not shown to scale.

The Renewal Sleeve

Figure 1:
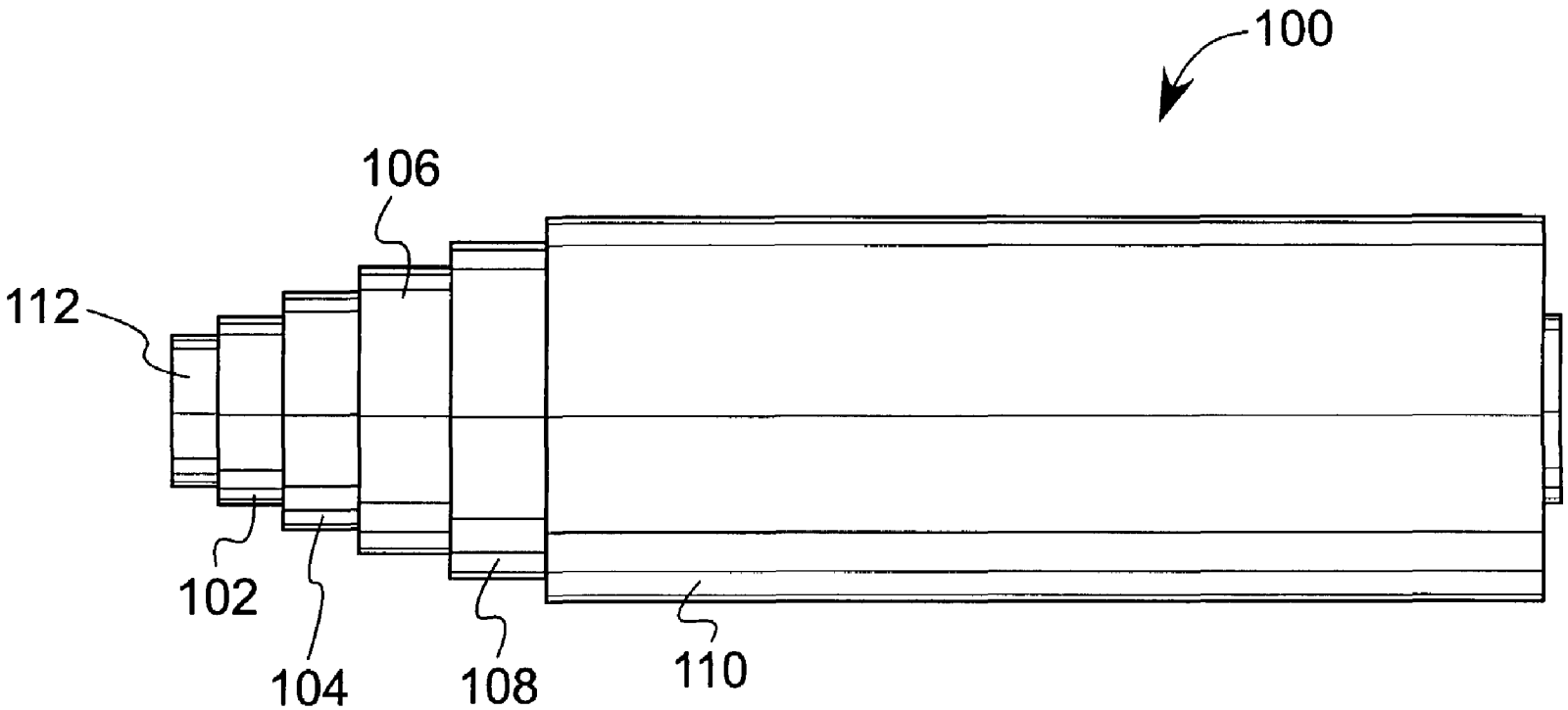
FIG. 1 is a diagrammatic view of a printing blanket sleeve mounted on a blanket cylinder according to one embodiment of the present invention, where the press has been removed for clarity, and the printing blanket sleeve is shown with layers that are cut away for illustrative purposes.

As shown in FIG. 1, a printing blanket sleeve 100 comprises a base sleeve 102, a first reinforcing layer 104, a compressible layer 106, a second reinforcing layer 108, and a printing face 110. The printing blanket sleeve 100 is mounted on a blanket cylinder 112 as shown. The blanket cylinder 112 is part of a printing press as is known in the art. As such, the printing press is not shown in FIG. 1.

In practice, various ones of the components of the printing blanket sleeve 100 are combined for form two discrete sleeves that may be assembled such that the two sleeves rotate on the blanket cylinder 112 as an integral unit. However, the sleeves may be separated so that the printing face 110 may be replaced and one or more of the underlying components recycled for multiple lifetimes as more fully explained herein. Each of the components of the printing blanket sleeve 100 are illustrated in cut out fashion progressively cut away from the left hand side of FIG. 1 so that each individual component may be identified and discussed.

The base sleeve 102 is preferably electroformed out of nickel. However, other suitable materials may be used including stainless steel, aramid fibers, carbon fiber reinforced epoxy, fiberglass reinforced plastic, or fiberglass reinforced polyester resin.

The first reinforcing layer 104 imparts a high coefficient of friction to the surface of the base sleeve 102. For example, the first reinforcing layer 104 may comprise a polymer wound cord, fabric, wound fibers such as polyester, cotton, fiberglass, cotton-wrapped polyester, rayon, carbon filaments, or other high modulus synthetic or organic fibers. Suitable synthetic fibers include for example, aramid fibers and fiberglass or polyester threads available from a variety of sources. The first reinforcing layer 104 is not required to practice the present invention. However, the first reinforcing layer 104 provides additional rigidity to the base sleeve 102, thus reducing the chance of damaging the base sleeve 102 during handling.

The compressible layer 106 is an elastomer having the required properties to perform applications typically associated with heat set web offset printing. The compressible layer 106 may be formed using techniques as known in the art. For example, an elastomeric compound including known processing, stabilizing, strengthening and curing additives may be used to form the compressible layer 106. Any suitable polymeric material that is considered a curable or vulcanizable material can be used, including for example, natural rubber, styrene-butadiene rubber (SBR), ethylene/propylene/nonconjugated dieneterpolymer rubber(EPDM), butyl rubber, neoprene, butadiene, acrylonitrile rubber (NBR), or polyurethanes. An elastomer that is resistant to solvents and ink is preferable. For example, the compressible layer 106 may include microspheres impregnated into an elastomer as disclosed in U.S. Pat. No. 4,770,928 entitled, "METHOD OF CURING A COMPRESSIBLE PRINTING BLANKET AND A COMPRESSIBLE PRINTING BLANKET PRODUCED THEREBY", and herein incorporated by reference.

The compressible layer 106 secures to the first reinforcing layer 104 using techniques as are known in the art. For example, in construction, a printing blanket sleeve comprises a nickel base sleeve, a first reinforcing layer, and a compressible layer applied over the reinforcing layer using conventional spreading machines. Alternatively, in a second construction, a compressible layer is formed directly onto a nickel base sleeve using pour or injection molding techniques. The compressible layer 106 may alternatively be applied using extrude spray spun processes or other techniques as is known in the art. Further, one skilled in the art will recognize that the compressible layer 106 may be substantially vulcanized prior to assembly, or may be secured to either the first reinforcing layer 104 or the base sleeve 102 by means of a suitable adhesive. Additionally, the compressible layer 106 may require additional processing and preparation. For example, it may be necessary to grind the compressible layer 106 to a desired dimension before completing assembly of the printing blanket sleeve 100.

The second reinforcing layer 108 is optional, and preferably comprises a layer of non-stretchable material. For example, the second reinforcing layer 108 may be a layer of woven or nonwoven fabric, a reinforcing film such as MYLAR (polyester), a reinforced film such as carbon fiber or aramid fiber, cord, fiberglass or a surface layer of hard polyurethane. Additionally, the second reinforcing layer 108 may be a sleeve similar in construction and materials as the base sleeve 102 described herein. Where the second reinforcing layer 108 is formed from a fabric layer, the material may include plain woven fabric from high grade cotton yarns, which are free from slubs and knots, weaving defects, seeds, etc. The fabric may also be rayon, nylon, polyester, or mixtures thereof.

The printing face 110 may be any printing surface as is known in the art. For example, the printing face 110 may comprise a strip formed around and adhesively held to the second reinforcing layer 108. Alternatively, the printing face 110 may comprise a gapless tubular composite such as an extruded face tube as is known in the art. The printing face 110 is secured to the surface of second reinforcing layer 108. For example, the printing face 110 may be adhesively affixed to the second reinforcing layer 108 using a rubber cement. It shall be observed that where a second reinforcing layer 108 is not used, the printing face 110 is secured to the compressible layer 106.

Two Piece Sleeve

Figure 2:
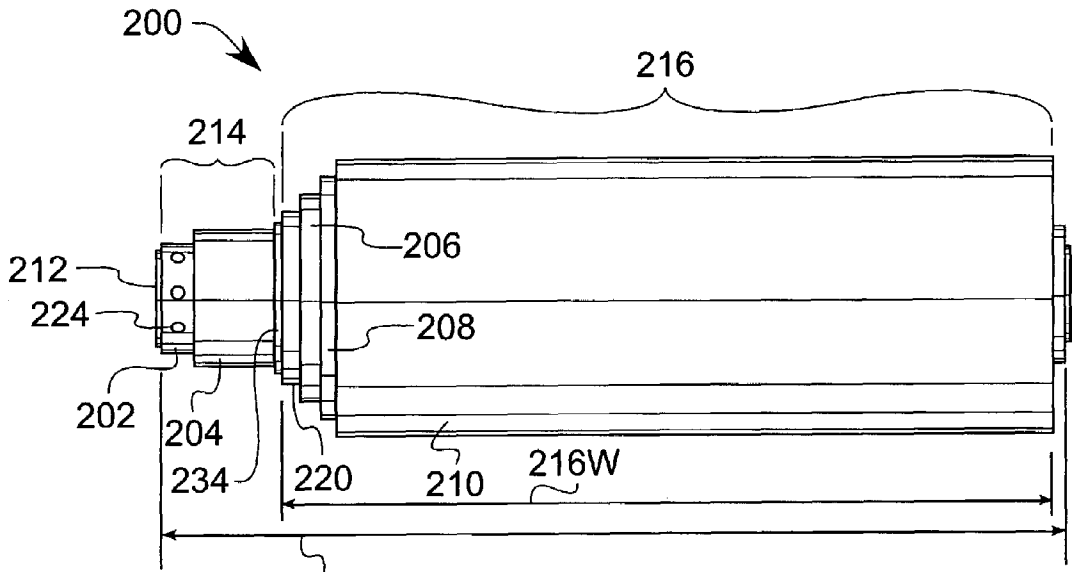
FIG. 2 is a diagrammatic view of a printing blanket sleeve mounted on a blanket cylinder according to another embodiment of the present invention, where the press has been removed for clarity, and the printing blanket sleeve is shown with layers that are cut away for illustrative purposes.

Referring to FIG. 2, the printing blanket sleeve 200 includes layers similar to the layers of the printing blanket sleeve 100 described with reference to FIG. 1. As such, like layers are identified with a reference number 100 higher than the corresponding layer discussed with reference to FIG. 1. Further, each of the layers of the printing blanket sleeve 200 are shown in cut away fashion for illustrative purposes and to facilitate discussion.

As shown in FIG. 2, a printing blanket sleeve 200 according to one embodiment of the present invention includes a carcass sleeve 214 and a face sleeve 216. The face sleeve 216 is mounted over, and secured to the carcass sleeve 214 such that lateral and rotational motion of the carcass sleeve 214 with respect to the face sleeve 216 is prevented. As such, the carcass sleeve 214 and the face sleeve 216 will rotate as an integral unit when properly installed on a suitable blanket cylinder 212. The face sleeve 216 comprises a printing face 210, and may optionally include one or more internal layers as more fully described herein. Further, the carcass sleeve 214 includes a base sleeve 202 and optionally one or more internal layers as more fully described herein.

Figure 3:
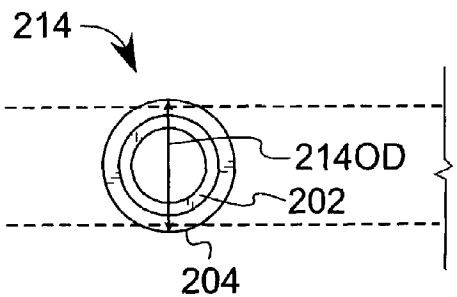
FIG. 3 is an end perspective of the carcass sleeve of the printing blanket sleeve according to FIG. 2.

As shown in FIGS. 2 and 3, the carcass sleeve 214 includes a base sleeve 202, and optionally, a first reinforcing layer 204. For example, the first reinforcing layer 204 may comprise a polymer wound cord or fabric that imparts a high coefficient of friction to the surface of the base sleeve 202, and provides rigidity to reduce the chances of damage to the base sleeve 202 during handling as more fully described herein.

Figure 4:
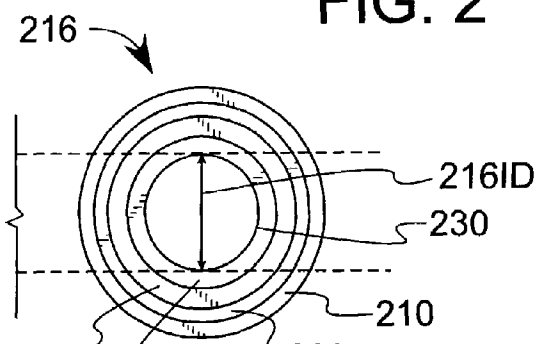
FIG. 4 is an end perspective of the face sleeve of the printing blanket sleeve according to FIG. 2.
Figure 10:
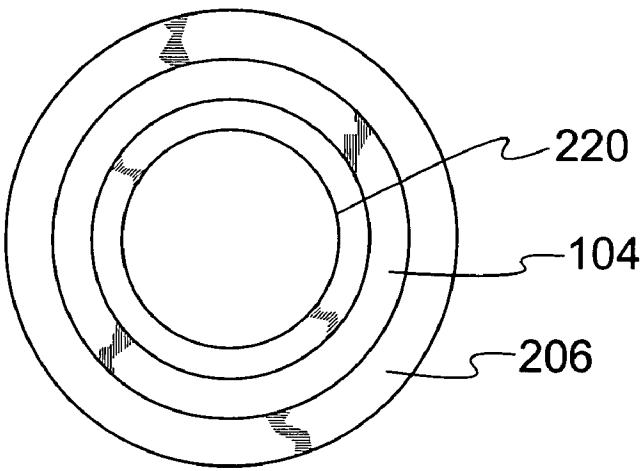
FIG. 10 is an end perspective view of the face sleeve of the printing blanket sleeve including a reinforce layer.

As best illustrated in FIG. 4, the face sleeve 216 is constructed by forming a first internal surface 220, forming a compressible layer 206 over the first internal surface 220, optionally applying a second reinforcing layer 208 over the compressible layer 206, and applying a printing face 210 over the second reinforcing layer 208. The first internal surface 220 defines an internal surface capable of being releasably securable to the carcass sleeve 214. The first internal surface 220 is constructed to have an internal surface capable of establishing a temporary bond with the outside surface of the carcass sleeve 214 while the printing blanket sleeve 200 is installed on a blanket cylinder. It shall be observed that the first internal surface 220 is shown in the figures as a separate layer for illustrative purposes. It shall be appreciated that the first internal surface 220 may be a separately formed layer, or alternatively be the inside surface of one of the layers. The exact approach to form the first internal surface 220 will depend upon the manner selected to temporarily secure the face sleeve 216 to the carcass sleeve 214. For example, the first internal surface 220 may comprise a nickel sleeve, or other material including those discussed with reference to the base sleeve 102 herein where the face sleeve 216 is floated over the carcass sleeve and secured thereto by friction as more fully described herein. Alternatively, the first internal surface may comprise the internal surface of the compressible layer 106 or other intermediate layers where the face sleeve is temporarily bonded to the carcass sleeve using mechanical, adhesive or chemical techniques as more fully explained herein. It shall be appreciated that optional reinforcing layers may be applied between the first internal surface 220 and the compressible layer 206 such as first or second reinforcing layers 104, 108. See FIG. 10.

Referring to FIG. 2, the carcass sleeve 214 is manufactured to have a width 214W generally equal to the width of the blanket cylinder 212 to which the printing blanket sleeve 200 is to be mounted. The face sleeve 216 may be manufactured to any desired width 216W, up to the width 214W of the carcass sleeve 214 and beyond, as a particular application dictates. For example, the face sleeve 216 may be manufactured to a width 216W, which is less than the width 214W of the carcass sleeve 216 and generally equal to the web width (not shown) according to job requirements. Further, the face sleeve 216 may be manufactured to a width 216W that is greater than the width 214W of the carcass sleeve 214 where the printing blanket sleeve 200 is assembled with certain air assist tools.

Referring to FIGS. 3 and 4, while both the carcass sleeve 214 and the face sleeve 216 are in relaxed states, the carcass sleeve 214 has an outer diameter 214OD greater than the inner diameter 216ID of the face sleeve 216. The face sleeve 216 is expanded radially outward by applying a pressurized gas, preferably compressed air, against the inner surface 230 of the first internal surface 220, and floated over the carcass sleeve 214.

Figure 5:
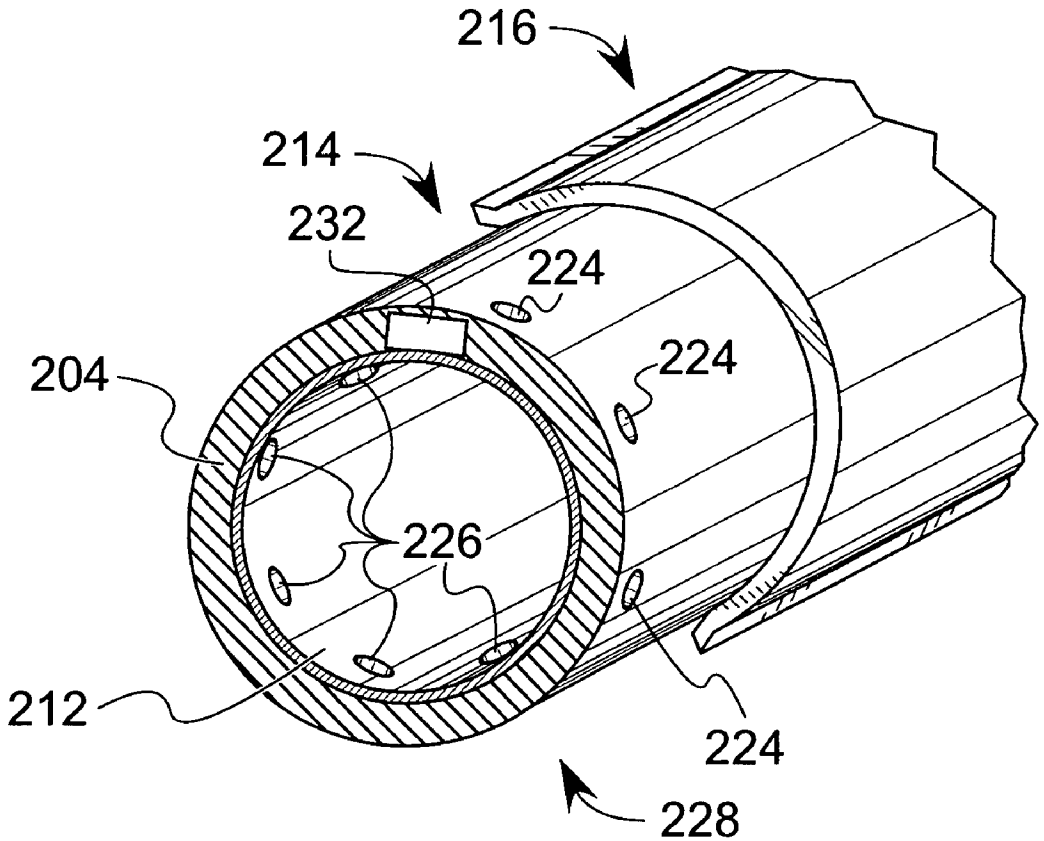
FIG. 5 is an isometric illustration of the carcass sleeve, and a cut-out portion of the face sleeve mounted on a blanket cylinder according to FIGS. 2–4, illustrating the alignment of apertures in the carcass sleeve with the aeration holes provided on the blanket cylinder.

As shown in FIG. 5, a plurality of through apertures 224 are provided along the surface of the carcass sleeve 214. The through apertures 224 are arranged to align with aeration holes 236 provided along the surface of the blanket cylinder 212 on which the printing blanket sleeve 200 is mountable. While the through apertures 224 are illustrated as being circumferentially positioned near the end portions 228 of the carcass sleeve 214, it shall be appreciated that the location of the aeration holes 226, and accordingly the location of the through apertures 224, may vary depending upon the configuration of the particular blanket cylinder 212 to which the printing blanket sleeve 200 is mountable. Further, it shall be appreciated that the through apertures 224 are illustrated with dashed lines to indicate that the through apertures 224 extend entirely through the carcass sleeve 214, to align with the aeration holes 226 provided along the blanket cylinder 212. The apertures 224 may be formed from porous materials with any varying levels of permeability placed strategically within one or more of the layers of the carcass sleeve 214, or throughout the entire carcass sleeve 214.

According to one embodiment of the present invention, the carcass sleeve 214 is positioned on the blanket cylinder 212 such that the through apertures 224 align substantially in register with aeration holes 226 provided along the surface of the blanket cylinder 212. The carcass sleeve 212 remains in position on the blanket cylinder while face sleeves 216 are mounted thereon, and removed therefrom. This allows the printing surface of the printing blanket sleeve 200 to be changed over directly on the printing press. Pressure is selectively applied from a source coupled to the blanket cylinder 212 as is known in the art. For example, the blanket cylinder 212 has a central lumen (not shown) and a plurality of passages extending radially from the central lumen. A source of pressurized gas communicates with the central lumen in the blanket cylinder 212, the plurality of passages and the inner surface of the printing blanket sleeve 200.

The first internal surface 220 is elastically expandable diametrically in a slight amount. As the face sleeve 216 is slid towards the carcass sleeve 214, the pressure forced through the aeration holes 226 and associated through apertures 224 causes expansion of the inside diameter of the face sleeve 216 radially outward, thus providing creep allowing the face sleeve 216 to slip on and off the carcass sleeve 214. Once the face sleeve 216 is properly situated on the carcass sleeve 214, the pressure source is removed. As such, the inside diameter of the face sleeve 216 contracts generally causing a tight frictional relationship to exist between the carcass sleeve 214 and the face sleeve 216. As such, the carcass sleeve 214 and the face sleeve 216 will operate as an integral unit when properly installed on a suitable blanket cylinder. The face sleeve 216 is expanded under moderate air pressure, for example, less than 100 psi, and slipped over the carcass sleeve 214 while in an expanded state.

The carcass sleeve 214 may optionally include an expansion/contraction valve 232 arranged to selectively provide expansion and contraction to the face sleeve 216. Such an arrangement may be desirable where the blanket cylinder does not provide aeration holes or where provided aeration holes do not sufficiently align with the through apertures provided through the carcass sleeve 214. An air hose or other source (not shown) is selectively coupled to the expansion/contraction valve 232 for providing the creep necessary to slip the face sleeve 216 over the carcass sleeve 214. Where an expansion/contraction valve 232 is provided on the carcass sleeve 214, it is not necessary that the apertures 224 need only be able to receive pressure radially outward. Therefore, the carcass sleeve 214 may require duct work or other passages to couple the expansion/contraction valve 232 to each of the plurality of apertures 224. It shall be observed that the face sleeve 216 may be wider than the carcass sleeve 214 under this arrangement to allow installation, trim, and the like to fit properly.

As an alternative to leaving the carcass sleeve 214 on the blanket cylinder 212, the entire printing blanket sleeve 200 may be removed from the blanket cylinder 212 prior to replacing the face sleeve 216. This approach is currently preferred over changing the face sleeve 216 while leaving the carcass sleeve 214 on the blanket cylinder 212. The printing blanket sleeve 200 is attached to a mounting frame (not shown), a new face sleeve 216 is placed on the carcass sleeve 214, and then the printing blanket sleeve 200 is replaced on the blanket cylinder 212. The mounting frame may include a pressure source that aligns with the through apertures in the carcass sleeve 214, or the carcass sleeve 214 may include an expansion/contraction valve 232. In either embodiment, the removal of the face sleeve 216 from the carcass sleeve 214 is substantially as described above.

It shall be appreciated that other mechanical bonding methods may be used with the present invention other than pure friction to secure the carcass sleeve 214 to the face sleeve 216. This may be desirable because under certain circumstances, through holes may cause printing problems. For example, a spline and taper lock arrangement (not shown) may be used where grooved passages are cut or molded on either the carcass sleeve 214 to fit matching forms on the face sleeve 216. Alternatively, "V" notch/groove techniques as are known in the art may be used. The surface of the carcass sleeve 214 may further be knurled. Additionally, friction materials with high coefficients of friction such as polyurethanes and nitrites may be used as is known in the art.

Referring to FIG. 2, where it is undesirable, or unpractical to use a compressed gas to float the face sleeve 216 off of the carcass sleeve 214, an optional bonding adhesive 234 may be applied between the carcass sleeve 214, and the face sleeve 216. The bonding adhesive 234 may be for example, a heat activated thermoplastic or thermoset bonding agent, such as polyvinyls, acrylics, polyurethanes, polyolefins, and thermoplastic esters. The bonding adhesive may be applied using any techniques known in the art, including for example ring coating or using an x-head extruder. Upon or during assembly of the face sleeve 216 to the carcass sleeve 214, heat is applied to the printing blanket sleeve 200 to activate the adhesive character of the bonding adhesive 234 applied thereto.

After removal of the heat, cooling completes the bonding process. The bonding adhesive 234 can be applied as an extruded tube, spiral wrapped tape, or directly coated. For example, bonding can be achieved by first applying heat to a predetermined level to melt the bonding adhesive 234. The bonding adhesive 234 will become a fluid when melted, allowing the face sleeve 216 to be slid onto the carcass sleeve 214. Then, by applying a higher heat, the bonding adhesive 234 cures and sets. The face sleeve 216 can be removed from the carcass sleeve 214 by applying a removal force, for example by heating the printing blanket sleeve 200 and removing the face sleeve 216 before the temperature cools sufficiently to reactivate the bonding properties of the bonding adhesive 234. When utilizing a heat activated adhesive to bond the face sleeve 216 to the carcass sleeve 214, it may be necessary to recondition the outer surface of the carcass sleeve 214 prior to installation of the new face sleeve 216. It shall be observed that the inside diameter 216ID of the face sleeve 216 need not be smaller than the outside diameter 214OD of the carcass sleeve 214 when using the bonding adhesive 234. Rather, the face sleeve 216 should be dimensioned to allow the face sleeve 216 to slide over the carcass sleeve 214.

As an alternative to the heat activated adhesive, the bonding adhesive 234 may be a solvent activated bonding adhesive agent or catalytic adhesive applied between the face sleeve 216 and the carcass sleeve 214. The bond is activated when the solvent is completely evaporated. To remove the face sleeve 216 from the carcass sleeve 214, a removing force is applied. For example, the face sleeve 216 is mechanically cut off, using care not to damage the carcass sleeve 214. As with the use of the heat activated adhesive, some reconditioning of the carcass sleeve 214 may be required prior to installing the new face sleeve 216. It shall be appreciated that other chemical adhesive systems can be utilized to secure the face sleeve 216 to the carcass sleeve 214.

It shall be observed that the printing blanket sleeve 200 may comprise any number of layers that can be divided between the carcass sleeve 214 and the face sleeve 216 in any number of ways so long as there is at least two separable sleeve components that can be mated in a manner such that the assembly of the carcass sleeve 214 and the face sleeve 216 operate as an integral unit when installed on a printing press. Preferably, the face sleeve 216 may be replaced from the carcass sleeve 214 either while the carcass sleeve 214 remains on the printing press (not shown) or alternatively, both the carcass sleeve 214 and the face sleeve 216 are removed from the printing press and the face sleeve 216 is replaced on-site, preferably near the printing press.

Figure 6:
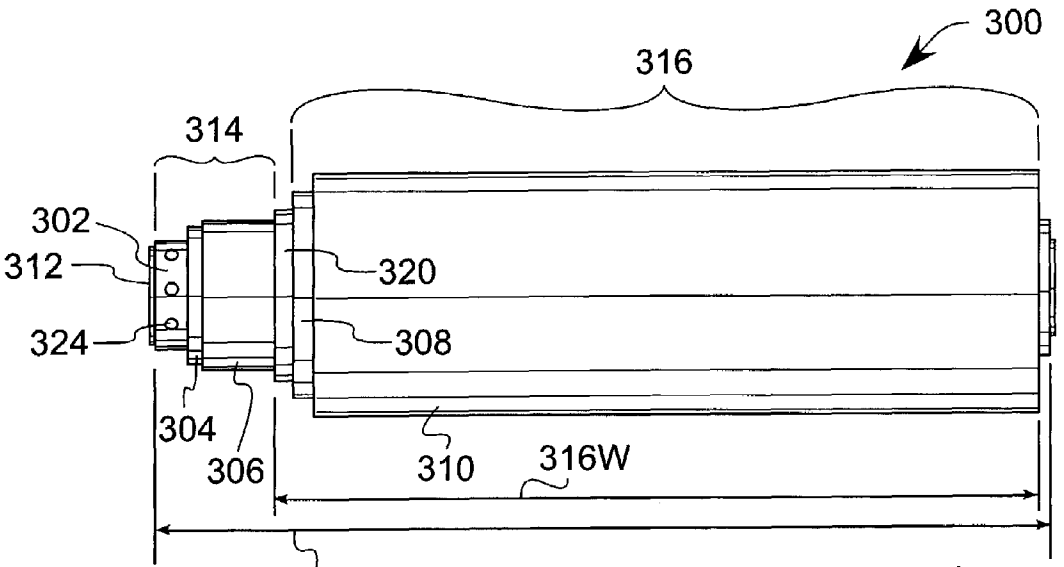
FIG. 6 is a diagrammatic view of a printing blanket sleeve mounted on a blanket cylinder according to another embodiment of the present invention, where the press has been removed for clarity, and the printing blanket sleeve is shown with layers that are cut away for illustrative purposes.
Figure 8:
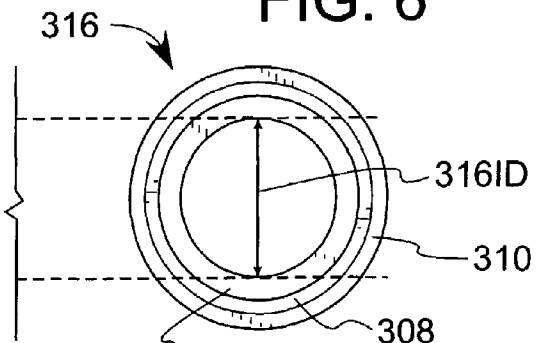
FIG. 8 is an end perspective of the face sleeve of the printing blanket sleeve according to FIG. 6.

Referring to FIG. 6, the printing blanket sleeve 300 includes similar layers as described above. As such, like layers are identified with a reference number 200 higher than the corresponding layer discussed with reference to FIG. 1. Further, each of the layers of the printing blanket sleeve 300 are shown in cut away fashion for illustrative purposes and to facilitate discussion. The embodiment of FIGS. 6–9 differs from the embodiment of FIGS. 2–5 in that the compressible layer is included with the face sleeve in FIGS. 2–5 and the compressible layer is included with the carcass sleeve in FIGS. 6–9

A printing blanket sleeve 300 is mounted on a blanket cylinder 312, and includes carcass sleeve 314, and a face sleeve 316. The face sleeve 316 is mounted onto, and secured to the carcass sleeve 314 such that lateral and rotational motion of the carcass sleeve 314 with respect to the face sleeve 316 is prevented. As such, the carcass sleeve 314 and the face sleeve 316 will rotate as an integral unit when properly installed on a suitable blanket cylinder 312.

The carcass sleeve 314 includes a base sleeve 302 and a compressible layer 306. It shall be observed that the carcass sleeve 314 may optionally include a first reinforcing layer 304 between the base sleeve 302 and the compressible layer 306 as described more fully herein. Further, a second reinforcing layer 308 may be applied over the compressible layer 306.

The face sleeve 316 includes a first internal surface 320, and a printing face 310 installed over the first internal surface 320. The first internal surface 320 may be the inside surface of an existing layer, or may be a layer specially provided to temporarily bond with the carcass sleeve as discussed above. For example, the printing face 310 may comprise an extruded face tube as discussed herein. The inside surface of the extruded face tube 310 may be prepared to have the properties required to releasably bond with the carcass sleeve, such as when using certain mechanical, chemical or adhesive bonding techniques. Optionally, one or more reinforcing layers and/or a layer specifically intended to releasably bond to the carcass sleeve may be required. For example, the printing face 310 may be secured to a sleeve such as a nickel sleeve. The nickel sleeve may be used to releasably secure to the carcass sleeve using frictional forces as more fully described herein.

Figure 7:
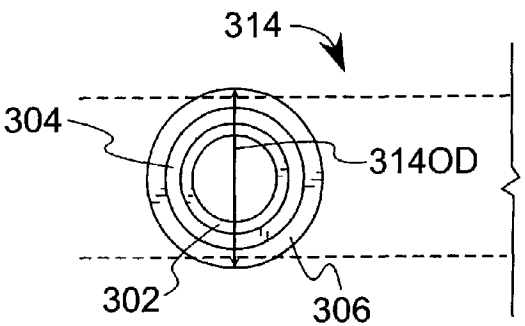
FIG. 7 is an end perspective of the carcass sleeve of the printing blanket sleeve according to FIG. 6.
Figure 9:
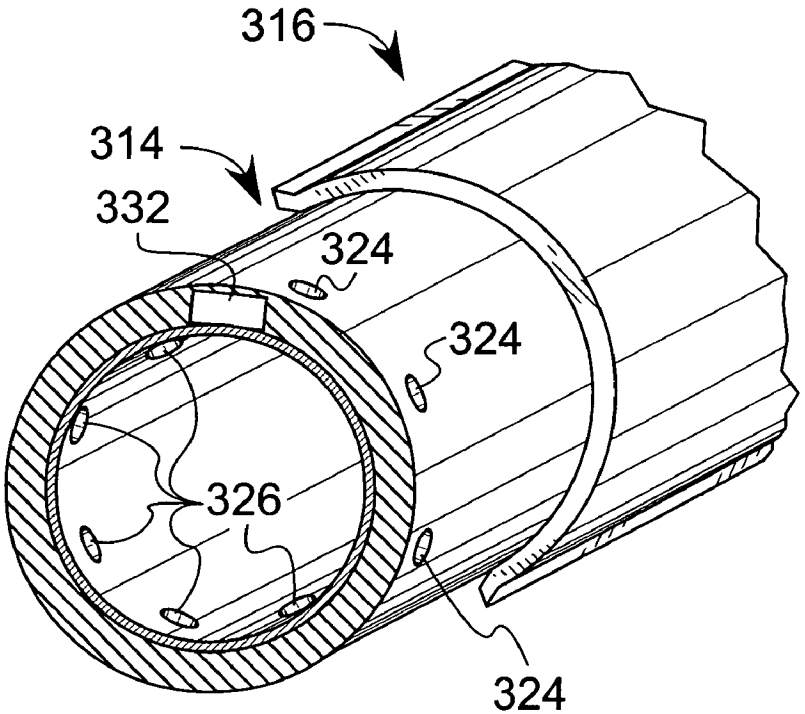
FIG. 9 is an diagrammatic view of the carcass sleeve, and a cut-out portion of the face sleeve mounted on a blanket cylinder according to FIGS. 6–8, illustrating the alignment of apertures in the carcass sleeve with the aeration holes provided on the blanket cylinder.

The face sleeve 316 is mounted onto the carcass sleeve 314 such that a relationship exists therebetween to prevent lateral and rotational motion of the carcass sleeve 314 with respect to the compressible face sleeve 316. Referring to FIGS. 6 and 7, while both the carcass sleeve 314 and the face sleeve 316 are in relaxed states, the carcass sleeve 314 has an outer diameter 314OD greater than the inner diameter 316ID of the face sleeve 316. Referring to FIG. 9, where pressure is used to expand the inner diameter of the first internal surface 320, a plurality of apertures 324 are provided along the surface of the carcass sleeve 314. Where the blanket cylinder 312 includes suitable aeration holes 326, the apertures 324 may be through apertures as described above. Likewise, where the carcass sleeve 314 includes an expansion/contraction valve 332, the apertures 324 need not extend entirely through the carcass sleeve 314.

It shall be appreciated by those skilled in the art that the printing blanket sleeve 300 differs from printing blanket sleeve 200 in the arrangement of the compressible layer and reinforcing layers. In the printing blanket sleeve 200, the compressible layer 306 is integral with the face tube 310. In contrast, the printing blanket sleeve 300 includes the compressible layer 306 integral with the carcass sleeve 314. Otherwise, the construction, materials, and techniques of assembly are identical to those described herein.

Further, the use of the bonding adhesive 234 discussed with reference to the two piece sleeve constructions discussed with reference to FIGS. 2–9 may be used on the renewal printing blanket sleeve discussed with reference to FIG. 1.

Having described the invention in detail and by reference to preferred embodiments thereof, it will be apparent that modifications and variations are possible without departing from the scope of the invention defined in the appended claims.

What is claimed is:

1. A printing blanket sleeve with replaceable printing surface comprising:

a carcass sleeve adapted to be securable to a blanket cylinder of a printing press said carcass sleeve comprising a base sleeve, at least one reinforcing layer and a compressible layer coupled to said reinforcing layer; and, a radially expandable face sleeve having a smooth printing face adapted to receive ink from a printing plate and further comprising a first internal surface coupled to said printing face, wherein said carcass sleeve has an outside diameter and said face sleeve has an inside diameter, said face sleeve inside diameter normally smaller than said outside diameter of said carcass sleeve, wherein said face sleeve is securable to said carcass sleeve such that said inside diameter of said face sleeve is expanded diametrically to fit over said carcass sleeve such that said face sleeve is secured to said carcass sleeve by frictional forces such that lateral and rotational motion of said carcass sleeve with respect to said face sleeve is prevented.

2. A printing blanket sleeve according to claim 1, wherein said carcass sleeve further comprises a plurality of apertures extending entirely through said carcass sleeve, said apertures arranged on said carcass sleeve to substantially align in register with aeration holes on said blanket cylinder when said carcass sleeve is mounted on said blanket cylinder, said apertures arranged to allow a user of said printing press to force gas through said aeration holes on said blanket cylinder and said apertures with sufficient force to expand said inner diameter of said face sleeve sufficient to allow said face sleeve to slide over said carcass sleeve.

3. A printing blanket sleeve according to claim 1, wherein said carcass sleeve further comprises a plurality of apertures extending through a portion of said carcass sleeve, and a compression/expansion valve coupled to said apertures, said expansion/contraction valve arranged to selectively accept a pressurized gas and force said pressurized gas through said apertures with sufficient force to expand said inner diameter of said face sleeve sufficient to allow said face sleeve to slide over said carcass sleeve.

4. A printing blanket sleeve according to claim 1, wherein: said face sleeve further comprises:

a compressible layer between said first internal surface and said printing face.

5. A printing blanket sleeve according to claim 4, wherein said face sleeve further comprises at least one reinforcing layer between said first internal surface and said printing face.

6. A printing blanket sleeve according to claim 1, wherein said base sleeve comprises electroformed nickel.

7. A printing blanket sleeve according to claim 1, wherein said printing face comprises an extruded face tube.

8. A printing blanket sleeve according to claim 1, wherein said face sleeve is insertable over said carcass sleeve by forcing air therebetween.

9. A printing blanket sleeve with a replaceable printing surface comprising:

a carcass sleeve comprising a base sleeve and a compressible layer coupled to said base sleeve; and, a face sleeve comprising a first internal surface and a smooth printing face adapted to receive ink from a printing plate coupled to said first internal surface, wherein said face sleeve is releasably securable to said carcass sleeve such that lateral and rotational motion of said carcass sleeve with respect to said face sleeve is prevented; said printing blanket sleeve further comprising a first reinforcing layer applied between said base sleeve and said compressible layer and a second reinforcing layer between said first internal surface and said printing face.

10. A printing blanket sleeve with a replaceable printing surface comprising:

a carcass sleeve comprising a base sleeve and a compressible layer coupled to said base sleeve; and, a face sleeve comprising a first internal surface and a smooth printing face adapted to receive ink from a printing plate coupled to said first internal surface, wherein said face sleeve is releasably securable to said carcass sleeve such that lateral and rotational motion of said carcass sleeve with respect to said face sleeve is prevented: wherein said first internal surface comprises electroformed nickel.

11. A printing blanket sleeve with a replaceable printing surface comprising:

a carcass sleeve comprising a base sleeve and a compressible layer coupled to said base sleeve; and, a face sleeve comprising a first internal surface and a smooth printing face adapted to receive ink from a printing plate coupled to said first internal surface, wherein said face sleeve is releasably securable to said carcass sleeve such that lateral and rotational motion of said carcass sleeve with respect to said face sleeve is prevented; wherein said carcass sleeve has an outside diameter and said face sleeve has an inside diameter, said face sleeve inside diameter normally smaller than said outside diameter of said carcass sleeve, wherein said face sleeve is securable to said carcass sleeve such that said inside diameter of said face sleeve is expanded diametrically to fit over said carcass sleeve such that said face sleeve is secured to said carcass sleeve by frictional forces; and wherein said carcass sleeve further comprises a plurality of apertures extending entirely through said carcass sleeve, said apertures arranged on said carcass sleeve to substantially align in register with aeration holes on a blanket cylinder of a printing press when said carcass sleeve is mounted on said blanket cylinder, said apertures arranged to allow a user of said printing press to force gas through said aeration holes on said blanket cylinder and said apertures with sufficient force to expand said inner diameter of said face sleeve sufficient to allow said face sleeve to slide over said carcass sleeve.

12. A printing blanket sleeve, with a replaceable printing surface comprising:

a carcass sleeve comprising a base sleeve and a compressible layer coupled to said base sleeve; and, a face sleeve comprising a first internal surface and a smooth printing face adapted to receive ink from a printing plate coupled to said first internal surface, wherein said face sleeve is releasably securable to said carcass sleeve such that lateral and rotational motion of said carcass sleeve with respect to said face sleeve is prevented; wherein said carcass sleeve has an outside diameter and said face sleeve has an inside diameter, said face sleeve inside diameter normally smaller than said outside diameter of said carcass sleeve, wherein said face sleeve is securable to said carcass sleeve such that said inside diameter of said face sleeve is expanded diametrically to fit over said carcass sleeve such that said face sleeve is secured to said carcass sleeve by frictional forces; and wherein said carcass sleeve further comprises a plurality of apertures extending through a portion of said carcass sleeve, and a compression/expansion valve coupled to said apertures, said expansion/contraction valve arranged to selectively accept a pressurized gas and force said pressurized gas through said apertures with sufficient force to expand said inner diameter of said face sleeve sufficient to allow said face sleeve to slide over said carcass sleeve.

13. A printing blanket sleeve with a replaceable printing surface comprising:

a carcass sleeve comprising:

a base sleeve;

a first reinforcing layer coupled to said base sleeve;

a compressible layer coupled to said first reinforcing layer; and, a plurality of through apertures along the surface of said base sleeve, said plurality of through apertures arranged to align with aeration holes provided by a blanket cylinder on which said printing blanket sleeve is securable;

a face sleeve comprising:

a first internal surface having an inside diameter less than the outside diameter of said carcass sleeve;

a second reinforcing layer coupled to said first internal surface; and, a printing face coupled to said second reinforcing layer, wherein said face sleeve is securable to said carcass sleeve such that the inside diameter of said face sleeve is expanded diametrically such that a frictional relationship exists between said carcass sleeve and said face sleeve to prevent lateral and rotational motion therebetween.

14. A method of manufacturing a printing blanket sleeve with a replaceable printing surface comprising the steps of:

forming a carcass sleeve comprising:

forming a base carrier sleeve and at least one reinforcing layer; forming a face sleeve to have an inside diameter smaller than the outside diameter of said carcass sleeve comprising the steps of:

forming a first internal surface;

securing a compressible layer over said first internal surface; and applying a radially expandable printing face over said compressible layer;

releasably securing said face sleeve to said base sleeve by radially expanding said face sleeve by air pressure, floating said face sleeve over said carcass sleeve, and terminating the air pressure, thus defining a frictional relationship between said carcass sleeve and said face sleeve such that lateral and rotational motion of said carcass sleeve with respect to said face sleeve is prevented.

15. A method of manufacturing a printing blanket sleeve according to claim 14, wherein said step of forming a base sleeve comprises electroforming said base sleeve out of nickel.

16. A method of manufacturing a printing blanket sleeve according to claim 14, wherein securing said compressible layer over said first internal surface comprises molding said compressible layer to said first internal surface.

17. A method of manufacturing a printing blanket sleeve according to claim 14, wherein securing said compressible layer over said first internal surface comprises applying a reinforcing layer over said first internal surface, and spreading said compressible layer over said reinforcing layer.

18. A method of manufacturing a printing blanket sleeve according to claim 14, further comprising a reinforcing layer between said compressible layer and said printing face.

19. A method of manufacturing a printing blanket sleeve according to claim 14, wherein said step of forming a first internal surface comprises electroforming said first internal surface out of nickel.

20. A method of manufacturing a printing blanket sleeve according to claim 14, wherein said step of applying a printing face comprises applying an extruded face tube.

21. A method of manufacturing a printing blanket sleeve with a replaceable printing surface comprising the steps of:

forming a carcass sleeve comprising:

forming a base carrier sleeve;

forming a face sleeve comprising the steps of:

forming a first internal surface;

securing a compressible layer over said first internal surface;

applying a printing face over said compressible layer; and releasably securing said face sleeve to said base sleeve such that lateral and rotational motion of said carcass sleeve with respect to said face sleeve is prevented; said method further comprising forming a plurality of through apertures along the surface of said carcass sleeve, said plurality of through apertures arranged to align with aeration holes provided by a blanket cylinder on which said printing blanket sleeve is mountable.

22. A method of manufacturing a printing blanket sleeve with a replaceable printing surface comprising the steps of:

forming a carcass sleeve comprising:

forming a base carrier sleeve;

forming a face sleeve comprising the steps of:

forming a first internal surface;

securing a compressible layer over said first internal surface;

applying a printing face over said compressible layer; and releasably securing said face sleeve to said base sleeve such that lateral and rotational motion of said carcass sleeve with respect to said face sleeve is prevented; wherein said step of forming a carcass sleeve further comprises forming apertures in said carcass sleeve and providing an expansion/contraction valve coupled to said apertures, said expansion/contraction valve adapted to initiate expansion and contraction.

23. A method of manufacturing a printing blanket sleeve with a replaceable printing surface comprising the steps of:

forming a carcass sleeve comprising:

forming a base sleeve;

applying a first reinforcing layer over said base sleeve; and, securing a compressible layer over said reinforcing layer;

forming a face sleeve comprising:

forming a first internal surface applying a second reinforcing layer to said first surface; and, securing a printing face to said second reinforcing layer, said printing face comprising an extruded face tube which is adapted to receive ink from a printing plate; and, releasably securing said face sleeve to said carcass sleeve such that lateral and rotational motion of said carcass sleeve with respect to said face sleeve is prevented.

24. A method of manufacturing a printing blanket sleeve according to claim 23, wherein said step of forming a base sleeve comprises electroforming said base sleeve out of nickel.

25. A method of manufacturing a printing blanket sleeve according to claim 23, wherein securing said compressible layer over said first reinforcing layer comprises molding said compressible layer to said first reinforcing layer.

26. A method of manufacturing a printing blanket sleeve according to claim 23, wherein:

forming said face sleeve comprises forming said face sleeve to have an inside diameter smaller than the outside diameter of said carcass sleeve; and, releasably securing said face sleeve to said carcass sleeve comprises radially expanding said face sleeve by air pressure, floating said face sleeve over said carcass sleeve, and terminating the air pressure, thus defining a frictional relationship between said carcass sleeve and said face sleeve to prevent lateral and rotational motion of said carcass sleeve with respect to said face sleeve.

27. A method of manufacturing a printing blanket sleeve with a replaceable printing surface comprising the steps of:

forming a carcass sleeve comprising:

forming a base sleeve; and, securing a compressible layer over said base sleeve;

forming a face sleeve comprising:

forming a first internal surface; and, securing a printing face to said first internal surface, said printing face adapted to receive ink from a printing plate; and, releasably securing said face sleeve to said carcass sleeve such that lateral and rotational motion of said carcass sleeve with respect to said face sleeve is prevented; wherein securing said compressible layer over said base sleeve comprises applying a reinforcing layer over said base sleeve, and spreading said compressible layer over said reinforcing layer.

28. A method of manufacturing a printing blanket sleeve with a replaceable printing surface comprising the steps of:

forming a carcass sleeve comprising:

forming a base sleeve; and, securing a compressible layer over said base sleeve;

forming a face sleeve comprising:

forming a first internal surface; and, securing a printing face to said first internal surface, said printing face adapted to receive ink from a printing plate; and, releasably securing said face sleeve to said carcass sleeve such that lateral and rotational motion of said carcass sleeve with respect to said face sleeve is prevented; wherein said step of forming a first internal surface comprises electroforming said first internal surface out of nickel.

29. A method of manufacturing a printing blanket sleeve with a replaceable printing surface comprising the steps of:

forming a carcass sleeve comprising:

forming a base sleeve; and, securing a compressible layer over said base sleeve;

forming a face sleeve comprising:

forming a first internal surface; and, securing a printing face to said first internal surface, said printing face adapted to receive ink from a printing plate; and, releasably securing said face sleeve to said carcass sleeve such that lateral and rotational motion of said carcass sleeve with respect to said face sleeve is prevented; said method further comprising forming a plurality of through apertures along the surface of said carcass sleeve, said plurality of through apertures arranged to align with aeration holes provided by a blanket cylinder on which said printing blanket sleeve is mountable.

30. A method of manufacturing a printing blanket sleeve with a replaceable printing surface comprising the steps of:

forming a carcass sleeve comprising:

forming a base sleeve; and, securing a compressible layer over said base sleeve;

forming a face sleeve comprising:

forming a first internal surface; and, securing a printing face to said first internal surface, said printing face adapted to receive ink from a printing plate; and, releasably securing said face sleeve to said carcass sleeve such that lateral and rotational motion of said carcass sleeve with respect to said face sleeve is prevented; wherein said step of forming a carcass sleeve further comprises forming apertures in said carcass sleeve and providing an expansion/contraction valve coupled to said apertures, said expansion contraction valve adapted to initiate expansion and contraction.

31. A method of manufacturing a printing blanket sleeve with a replaceable printing surface comprising the steps of:

forming a base sleeve;

securing a compressible layer over said base sleeve to define a carcass sleeve having an outer diameter;

forming a plurality of through apertures along the surface of said carcass sleeve, said plurality of through apertures arranged to align with aeration holes provided by a blanket cylinder on which said printing blanket sleeve is mountable;

forming a first internal surface;

securing a printing face over said first internal surface to define a face sleeve having a print surface inner diameter that is less than said outer diameter;

applying pressure to expand said printing surface radially outward;

floating said printing surface over said compressible carcass sleeve; and, removing said pressure to said printing surface wherein a frictional relationship exists between said carcass sleeve and said face sleeve to prevent lateral and rotational motion therebetween.

32. A method of replacing a print surface on a printing blanket sleeve, comprising:

providing a printing blanket sleeve comprising a carcass sleeve which includes at least one reinforcing layer and a printing surface sleeve assembly mounted on said carcass sleeve;

applying a removing force to said printing blanket sleeve such that said printing blanket sleeve separates into said carcass sleeve and said printing surface sleeve assembly by radially expanding said printing surface sleeve assembly;

removing said printing surface sleeve assembly from said carcass sleeve;

inserting a new printing surface sleeve assembly over said carcass sleeve; and, securing said new printing surface sleeve assembly to said carcass sleeve.

33. A method of replacing a print surface on a printing blanket sleeve, said printing blanket sleeve including a face sleeve inserted over a carcass sleeve, said carcass sleeve further comprising at least one reinforcing layer, and being installed on a blanket cylinder comprising:

applying air pressure to said printing blanket sleeve such that said face sleeve floats off of said carcass sleeve;

floating a new face sleeve over said carcass sleeve while air pressure is applied to said printing blanket sleeve; and, removing the air pressure from said printing blanket sleeve such that said new face sleeve is frictionally secured to said carcass sleeve.

34. A method of replacing a print surface on a printing blanket sleeve according to claim 33, wherein said step of applying air pressure to said printing blanket sleeve further comprises using air pressure to radially expand said face sleeve such that said face sleeve floats over said carcass sleeve.

35. A method of replacing a print surface on a printing blanket sleeve according to claim 33, wherein said carcass sleeve remains secured to said blanket cylinder while said printing surface sleeve is replaced.

36. A method of replacing a print surface on a printing blanket sleeve including a face sleeve inserted over a carcass sleeve and being installed on a blanket cylinder comprising:

applying air pressure to said printing blanket sleeve such that said face sleeve floats off of said carcass sleeve;

floating a new face sleeve over said carcass sleeve while air pressure is applied to said printing blanket sleeve;

removing the air pressure from said printing blanket sleeve such that said new face sleeve is frictionally secured to said carcass sleeve; said method including removing said printing blanket sleeve from said blanket cylinder and attaching said printing blanket sleeve to a mounting frame before applying air pressure to said printing blanket sleeve; and replacing said printing blanket sleeve on said blanket cylinder after said new printing surface sleeve is floated over said carcass sleeve.

* * * * *

UNITED STATES PATENT AND TRADEMARK OFFICE

CERTIFICATE OF CORRECTION

PATENT NO. : 7,011,021 B2
APPLICATION NO. : 09/950184
DATED : March 14, 2006
INVENTOR(S) : Dzierzynski et al.

It is certified that error appears in the above-identified patent and that said Letters Patent is hereby corrected as shown below:

Col. 2, line 67 “reinforce” should read --reinforcing;

Col. 6, line 10 “236” should read --226--;

Col. 7, line 7 “pressure radially” should read -- pressure from a source coupled to the expansion/contraction valve 232, and direct the pressure radially--;

Col. 10, line 66 “prevented:” should read --prevented;--; and

Col. 13, line 39 “first surface” should read --first internal surface--.

Signed and Sealed this

Fifth Day of September, 2006

JON W. DUDAS
*Director of the United States Patent and Trademark Office*